US008387772B2

(12) United States Patent
Nagao

(10) Patent No.: US 8,387,772 B2
(45) Date of Patent: Mar. 5, 2013

(54) MISSING STEP DETECTION DEVICE OF PASSENGER CONVEYOR

(75) Inventor: Yukiyasu Nagao, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 296 days.

(21) Appl. No.: 12/937,428

(22) PCT Filed: Jun. 9, 2008

(86) PCT No.: PCT/JP2008/060524

§ 371 (c)(1),
(2), (4) Date: Oct. 12, 2010

(87) PCT Pub. No.: WO2009/150704

PCT Pub. Date: Dec. 17, 2009

(65) Prior Publication Data

US 2011/0031090 A1 Feb. 10, 2011

(51) Int. Cl.
*B66B 25/00* (2006.01)
*B66B 29/00* (2006.01)

(52) U.S. Cl. ..... 198/323; 198/321; 198/322; 198/326; 198/327; 198/330

(58) Field of Classification Search ..... 198/321, 198/322, 323, 326, 327, 330
See application file for complete search history.

(56) References Cited

U.S. PATENT DOCUMENTS

| | | | | |
|---|---|---|---|---|
| 5,316,121 | A * | 5/1994 | Zaharia et al. | 198/323 |
| 2003/0000798 | A1 * | 1/2003 | Williams et al. | 198/321 |
| 2006/0006045 | A1 * | 1/2006 | Stripling et al. | 198/323 |

FOREIGN PATENT DOCUMENTS

| | | |
|---|---|---|
| JP | 4 136379 | 5/1992 |
| JP | 5 8980 | 1/1993 |
| JP | 6 211480 | 8/1994 |
| JP | 7 257866 | 10/1995 |
| JP | 2001 89059 | 4/2001 |
| JP | 2005 255303 | 9/2005 |

OTHER PUBLICATIONS

International Search Report issued Mar. 3, 2009 in PCT/JP08/60524 filed Jun. 9, 2008.

* cited by examiner

*Primary Examiner* — Leslie A Nicholson, III
(74) *Attorney, Agent, or Firm* — Oblon, Spivak, McClelland, Maier & Neustadt, L.L.P.

(57) ABSTRACT

Provided is a missing step detection device which can be miniaturized even when the clearance between adjacent steps is wide. The missing step detection device has a plurality of steps which are connected together in an endless manner and perform circulating movement, a first proximity sensor which is provided outside the steps in the vicinity of the steps and detects step surfaces of the steps which are approaching, a second proximity sensor which is provided in the vicinity of the steps so as to detect portions of the steps which are approaching, and detects portions of the steps which are different from the steps whose step surfaces are detected by the first proximity sensor for a shorter time than the time during which the first proximity sensor is detecting the step surfaces, and a judgment device which judges that there is no missing condition of the steps when the first proximity sensor detects the step surfaces during the detection of portions of the steps by the second proximity sensor, and judges that there is a missing condition of the steps when the first proximity sensor does not detect the step surfaces.

5 Claims, 1 Drawing Sheet

MISSING STEP DETECTION DEVICE OF PASSENGER CONVEYOR

TECHNICAL FIELD

The present invention relates to a missing step detection device of a passenger conveyor.

BACKGROUND ART

A passenger conveyor is provided with a missing step detection device. This missing step detection device is intended for preventing a passenger conveyor from coming into an ordinary operating state, with the step removed for maintenance and for other purposes kept unattached after the completion of the maintenance. Conventional missing step detection devices have detected a missing condition of steps by pressing a roller against the steps and sensing positional changes of the roller. In these missing step detection devices, the wear of the roller has a great effect on the life of the devices. However, passenger conveyors are constantly continuing operations. For this reason, even when the durability of the roller is increased, there has been a limit to the life extending of missing step detection devices.

Therefore, there has been proposed a missing step detection device which measures the dimension of the clearance between adjacent steps in a noncontact manner by use of an induction proximity detector and judges that there is a missing condition of steps when this dimension of the clearance is larger than a threshold value. This missing step detection device uses no roller. This enables the life of the missing step detection device to be extended (refer to Patent Document 1, for example).

Patent Document 1: Japanese Patent Laid-Open No. 6-211480

DISCLOSURE OF THE INVENTION

Problems to be Solved by the Invention

However, in the missing step detection device described in Patent Document 1, when the clearance between adjacent steps in a normal state is wide, it is necessary that a threshold value used in judging that there is a missing condition of steps be set at a large value. For this reason, it is necessary to increase the size of the induction proximity detector and this has prevented the miniaturization of missing step detection devices.

The present invention has been made to solve the problem described above and the object of the invention is to provide a missing step detection device which can be miniaturized even when the clearance between adjacent steps is wide.

Means for Solving the Problems

A missing step detection device of a passenger conveyor of the present invention comprises a plurality of steps which are connected together in an endless manner and perform circulating movement, a first proximity sensor which is provided outside the steps in the vicinity of the steps and detects step surfaces of the steps which are approaching, a second proximity sensor which is provided in the vicinity of the steps so as to detect portions of the steps which are approaching, and detects portions of the steps which are different from the steps whose step surfaces are detected by the first proximity sensor for a shorter time than the time during which the first proximity sensor is detecting the step surfaces, and a judgment device which judges that there is no missing condition of the steps when the first proximity sensor detects the step surfaces during the detection of portions of the steps by the second proximity sensor, and judges that there is a missing condition of the steps when the first proximity sensor does not detect the step surfaces.

Advantage of the Invention

According to the present invention, it becomes possible to miniaturize missing step detection devices even when the clearance between adjacent steps is wide.

DESCRIPTION OF SYMBOLS

| | |
|---|---|
| 1 | main frame, |
| 2a to 2j | steps, |
| 3a to 3j | risers, |
| 4a to 4j | step surfaces, |
| 5 | first proximity sensor, |
| 5a | first detection region, |
| 5b | first detection signal, |
| 6 | second proximity sensor, |
| 6a | second detection region, |
| 6b | second detection signal, |
| 7 | judgment device |

BEST METHOD FOR CARRYING OUT THE INVENTION

The best mode for carrying out the present invention will be described with reference to the accompanying drawings. Note that, in each of the figures, like numerals refer to like or similar portions and overlaps of description of these portions are appropriately simplified or omitted.

Embodiment 1

Figure 1:
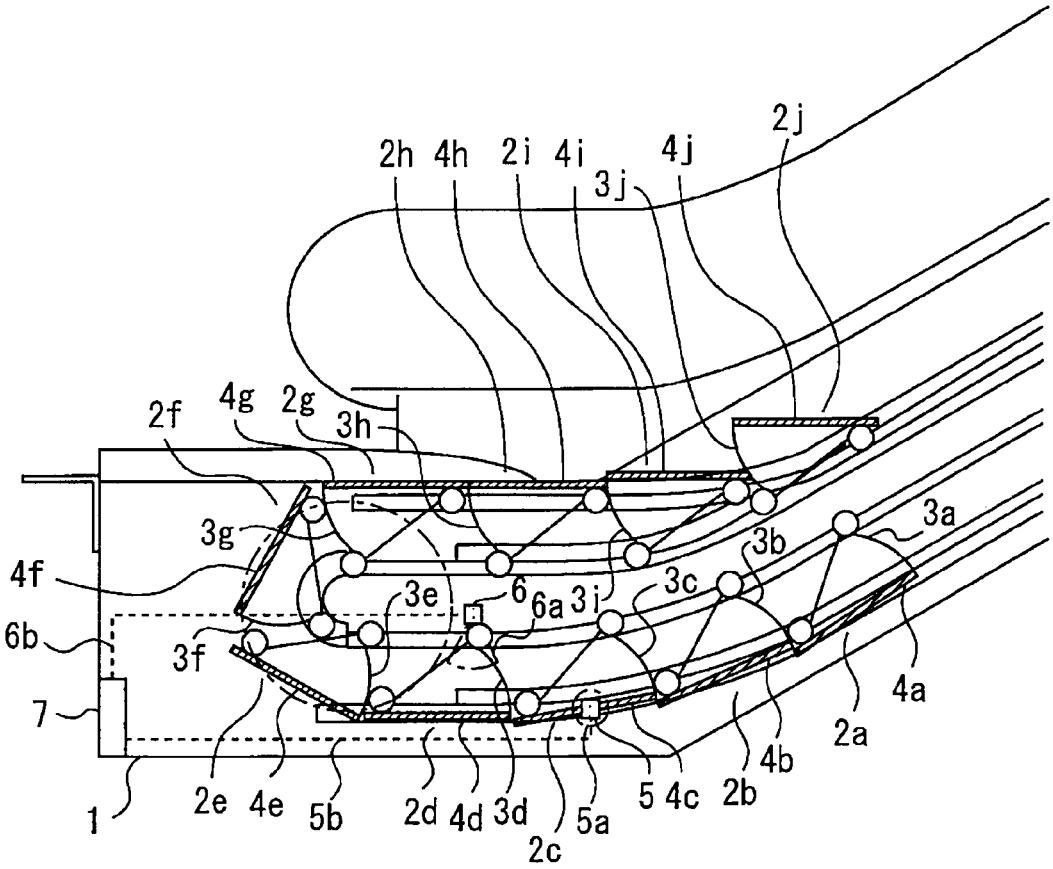
FIG. 1 is a diagram showing a missing step detection device of a passenger conveyor in Embodiment 1 of the present invention.

FIG. 1 is a diagram showing a missing step detection device of a passenger conveyor in Embodiment 1 of the present invention. FIG. 1 shows the longitudinal section of the bottom end of the passenger conveyor.

In FIG. 1, reference numeral 1 denotes a main frame of the passenger conveyor. Reference numerals 2*a* to 2*j* denote a plurality of steps. These steps 2*a* to 2*j* are connected together in an endless manner within the main frame 1 and perform circulating movement. These steps 2*a* to 2*j* comprise risers 3*a* to 3*j* and step surfaces 4*a* to 4*j*. The risers 3*a* to 3*j* are arranged in such a manner that curved surfaces thereof face in the circulating movement direction. The step surfaces 4*a* to 4*j* are arranged so as to face along the circulating movement direction.

Reference numeral 5 denotes a first proximity sensor. This first proximity senor 5 is provided in the vicinity of the step 2*c* outside the steps 2*a* to 2*j* and the like. This first proximity sensor 5 has a first detection region 5*a*. This first detection region 5*a* extends horizontally and becomes orthogonal to the circulating movement direction of the step 2*c*. The first proximity sensor 5 detects the steps 4*a* to 4*j* and the like passing the first detection region 5*a*. And upon such detection, the first proximity sensor 5 outputs a first detection signal 5*b*.

Reference numeral 6 denotes a second proximity sensor. This second proximity sensor 6 is provided in the vicinity of the step 2*d* nearer to the bottom end side of the passenger conveyor than the first proximity sensor 5 and between the returning-side steps 2*a* to 2*d* and the going-side steps 2*g* to 2*j*. This second proximity sensor 6 has a second detection region 6*a*. This second detection region 6*a* extends vertically downward and becomes orthogonal to the circulating movement direction of the step 2*d*. The second proximity sensor 6 is provided so as to detect portions of the steps 2*a* to 2*j* and the like passing the second detection region 6*a*.

Concretely, the second proximity sensor 6 detects portions of the steps 4*a* to 4*j* and the like which are different from the steps 4*a* to 4*j* and the like whose step surfaces 4*a* to 4*j* and the like are detected by the first proximity sensor 5 for a shorter time than the time during which the first proximity sensor 5 is detecting the step surfaces 4*a* to 4*j* and the like. More concretely, the second proximity sensor 6 detects end portions of the risers 3*a* to 3*j* and the like of the steps 2*a* to 2*j* and the like. And upon such detection, the second proximity sensor 6 outputs a second detection signal 6*b*.

Reference numeral 7 denotes a judgment device. A first detection signal 5*b* and a second detection signal 6*b* are inputted to this judgment device 7. And on the basis of the input condition of the first detection signal 5*b* during the input of the second detection signal 6*b*, the judgment device 7 makes a judgment as to whether there is any missing condition of the steps 2*a* to 2*j* and the like. Concretely, the judgment device 7 judges that there is no missing condition of the steps 2*a* to 2*j* or the like when the first proximity sensor 5 detects the step surfaces 4*a* to 4*j* and the like during the detection of the end portions of the risers 3*a* to 3*j* and the like by the second proximity sensor 6, and the judgment device 7 judges that there is a missing condition of the steps 2*a* to 2*j* and the like when the first proximity sensor 5 does not detect the step surfaces 4*a* to 4*j* or the like.

Next, the operation of the missing step detection device will be described in more detail with the aid of FIG. 2.

Figure 2:
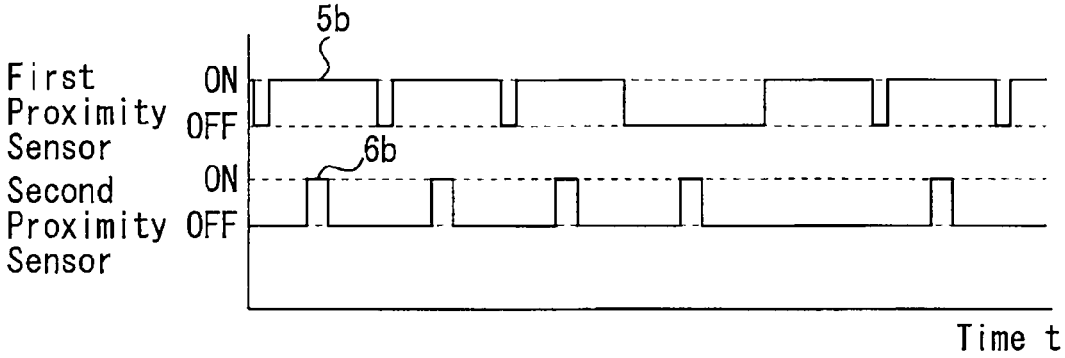
FIG. 2 is a timing chart to explain the operation timing of the first and second proximity sensors in the missing step detection device of a passenger conveyor in Embodiment 1 of the present invention.

FIG. 2 is a timing chart to explain the operation timing of the first and second proximity sensors in the missing step detection device of a passenger conveyor in Embodiment 1 of the present invention.

In FIG. 2, the abscissa indicates time, and the ordinate indicates the action condition (ON state) and non-action condition (OFF state) of the first and second proximity sensors 5 and 6. Concretely, the first and second proximity sensors 5 and 6, in their respective ON states, output a first detection signal 5*b* and a second detection signal 6*b*, respectively. On the other hand, the first and second proximity sensors 5 and 6, in their respective OFF states, output no first detection signal 5*b* and no second detection signal 6*b*, respectively.

First, consideration will be given to a normal state in which there is no missing condition of the steps 2*a* to 2*j* or the like. The risers 3*a* to 3*j* and the like are arranged in such a manner that curved surfaces thereof face the circulating movement direction. For this reason, the dimension of the end portions of the risers 3*a* to 3*j* and the like in the circulating movement direction passing the second detection region 6*a* is by far shorter than dimension of the steps 2*a* to 2*j* and the like in the circulating movement direction. That is, the second proximity sensor 6 outputs a second detection signal 6*b* only for the very short duration during which the end portions of the risers 3*a* to 3*j* and the like are approaching.

On the other hand, the step surfaces 4*a* to 4*j* and the like are arranged so as to face along the circulating movement direction. For this reason, the dimension of the steps 4*a* to 4*j* and the like in the circulating movement direction passing the first detection region 5*a* becomes substantially equal to the dimension of the steps 2*a* to 2*j* and the like in the circulating movement direction. That is, it is only for the duration during which the very small clearance formed between adjacent steps 2*a* to 2*j* and the like is approaching that the first proximity sensor 5 does not output a first detection signal 5*b*.

That is, in the case of a normal state, while the second proximity sensor 6 is detecting the ends of the risers 3*a* to 3*j* and the like of the steps 2*a* to 2*j* and the like, the first proximity sensor 5 is sure to detect the step surfaces 4*a* to 4*j* and the like of other steps 2*a* to 2*j* and the like. In such a state, the judgment device 7 judges that there is no missing condition of the steps 2*a* to 2*j* or the like.

Next, consideration will be given to a state in which there is a missing condition of the steps 2*a* to 2*j* and the like.

A large clearance is formed in the place where a missing condition of the steps 2*a* to 2*j* and the like occurs. When this clearance is approaching the first proximity sensor 5, a first detection signal 5*b* is not outputted irrespective of the output of a second detection signal 6*b* due to the approach of the end portions of the risers 3*a* to 3*j* and the like of the steps 2*a* to 2*j* and the like toward the second proximity sensor 6. Such a state is judged by the judgment device 7 to be a missing condition of the steps 2*a* to 2*j* and the like.

Furthermore, the judgment device 7 has also a function for judging an ON fault and an OFF fault of the first and second proximity sensors 5 and 6. Such judgment is performed by a logic circuit. The first and second proximity sensors 5 and 6 have the same normal detection period. However, the first and second proximity sensors 5 and 6 have different detection timings. An ON fault and an OFF fault of the first and second proximity sensors 5 and 6 are judged by using such detection period and detection timings.

Concretely, the judgment device 7 judges that the first proximity sensor 5 is in a fault condition in which the first proximity sensor 5 cannot stop the output of the first detection signal 5*b* in a case where the first detection signal 5*b* is being inputted without interruption for the duration in which the second detection signal 6*b* is inputted again after the input of the second detection signal 6*b*.

Also, the judgment device 7 judges that the second proximity sensor 6 is in a fault condition in which the second proximity sensor 6 cannot output the second detection signal 6*b* in a case where the second detection signal 6*b* is not inputted while the first detection signal 5*b* is inputted.

The judgment device 7 judges that the second proximity sensor 6 is in a fault condition in which the second proximity sensor 6 cannot stop the output the second detection signal 6*b* in a case where the second detection signal 6*b* is inputted when the first detection signal 5*b* is not inputted.

According to Embodiment 1 described above, the judgment device 7 judges a missing condition of the steps 2*a* to 2*j* and the like on the basis of the input condition of the first detection signal 5*b* during the input of the detection signal 6*b*. For this reason, it is unnecessary to directly measure the dimension of clearance of adjacent steps 2*a* to 2*j* and the like. That is, it is enough that the first and second proximity sensors 5 and 6 are capable of detecting the end portions of the risers 3*a* to 3*j* and the like and step surfaces 4*a* to 4*j* and the like, respectively, of the steps 2*a* to 2*j* and the like. For this reason, it becomes possible to miniaturize the first and second proximity sensors 5 and 6. That is, the whole missing step detection device becomes miniaturized.

Judgment as to whether there is a missing condition of the steps 2*a* to 2*j* and the like is made in synchronization with an ON action of the second proximity sensor 6. For this reason, it is possible to detect a missing condition of the steps 2*a* to 2*j* and the like regardless of the operation speed of the passenger conveyor. This makes it unnecessary to use a timing timer for measuring the timing of judgment on a missing condition of the steps 2*a* to 2*j* and the like. That is, the simplification of the missing step detection device is accomplished. The judgment device 7 has a self-judgment function for an ON fault and an OFF fault of the first and second proximity sensors 5 and 6. For this reason, the reliability of the missing step detection device is improved.

Incidentally, in Embodiment 1, the description was given of the case where the first and second proximity sensors 5 and 6 are provided on the bottom end side of the passenger conveyor. However, the first and second proximity sensors 5 and 6 may also be provided on the top end side of the passenger conveyor. If the first and second proximity sensors 5 and 6 are provided at the top and bottom ends of the passenger conveyor, then a missing condition of the steps 2*a* to 2*j* and the like is detected before the missing portions of the steps 2*a* to 2*j* and the like are exposed to the going side. And if the operation of the passenger conveyor is stopped as a result of such detection of a missing condition, the safety of the passenger conveyor is ensured.

The missing step detection device may also be provided with a selection switch to determine whether or not a missing condition of the steps 2*a* to 2*j* and the like is detected by use of the judgment device 7. In this case, if the non-detection of a missing condition of the steps 2*a* to 2*j* and the like is selected, it is possible to cause the steps 2*a* to 2*j* and the like to perform circulating movement, with a missing condition allowed in the steps 2*a* to 2*j* and the like. This improves the convenience when the maintenance work of the passenger conveyor is performed.

Furthermore, there may be provided an indication device which indicates that the detection of a missing condition of the steps 2*a* to 2*j* and the like by the judgment device 7 is stopped. In this case, maintenance personnel and other persons can recognize the non-detection of a missing condition of the steps 2*a* to 2*j* and the like and the safety of maintenance work is accomplished.

Incidentally, the missing step detection device may become operative automatically after the continuous operation of the passenger conveyor for a duration longer than a specific time, with the detection of a missing condition of the steps 2*a* to 2*j* and the like by the judgment device 7 stopped. In this case, even when the maintenance personnel and other persons forget to perform the operation to make the missing step detection device operative after the finish of maintenance work, it is ensured that the missing step detection device's function to stop the passenger conveyor is made operative when the judgment device 7 judges that there is no missing condition of the steps 2*a* to 2*j* and the like in a continuous operation of the steps 2*a* to 2*j* and the like for a duration of one cycle or more. For this reason, the safety of the passenger conveyor is further improved.

In Embodiment 1, the description was given of the case where the end portions of the risers 3*a* and 3*j* and the like are detected by the first proximity sensor 5. However, it is needless to say that the same effect is obtained also by detecting step rollers in the vicinity of the end portions of the risers 3*a* to 3*j* and the like and step shafts fixing the steps 2*a* to 2*j* and the like through the use of the first proximity sensor 5.

INDUSTRIAL APPLICABILITY

As described above, the missing step detection device of a passenger conveyor according to the present invention can be used in a passenger conveyor in which a missing condition of the steps is detected.

The invention claimed is:

1. A missing step detection device of a passenger conveyor, comprising:

a plurality of steps which are connected together in an endless manner and perform circulating movement;

a first proximity sensor which is provided outside the steps in the vicinity of the steps and detects step surfaces of the steps which are approaching;

a second proximity sensor which is provided in the vicinity of the steps so as to detect portions of the steps which are approaching, and detects portions of the steps which are different from the steps whose step surfaces are detected by the first proximity sensor for a shorter time than the time during which the first proximity sensor is detecting the step surfaces; and a judgment device which judges that there is no missing condition of the steps when the first proximity sensor detects the step surfaces during the detection of portions of the steps by the second proximity sensor, and judges that there is a missing condition of the steps when the first proximity sensor does not detect the step surfaces.

2. The missing step detection device of a passenger conveyor according to claim 1, wherein the first proximity sensor outputs a first detection signal while detecting the step surfaces of the steps;

wherein the second proximity sensor outputs a second detection signal while detecting portions of the steps; and wherein the judgment device judges that the first proximity sensor is in a fault condition in which the first proximity sensor cannot stop the output of the first detection signal in a case where the first detection signal and the second detection signal are inputted and the first detection signal is inputted without interruption for the duration in which the second detection signal is inputted again after the input of the second detection signal.

3. The missing step detection device of a passenger conveyor according to claim 1, wherein the first proximity sensor outputs a first detection signal while detecting the step surfaces of the steps;

wherein the second proximity sensor outputs a second detection signal while detecting portions of the steps; and wherein the judgment device judges that the second proximity sensor is in a fault condition in which the second proximity sensor cannot output the second detection signal in a case where the second detection signal is not inputted while the first detection signal is inputted.

4. The missing step detection device of a passenger conveyor according to claim 1, wherein the first proximity sensor outputs a first detection signal while detecting the step surfaces of the steps;

wherein the second proximity sensor outputs a second detection signal while detecting portions of the steps; and wherein the judgment device judges that the second proximity sensor is in a fault condition in which the second proximity sensor cannot stop the output of the second detection signal in a case where the second detection signal is inputted when the first detection signal is not inputted.

5. The missing step detection device of a passenger conveyor according to claim 1, wherein the first proximity sensor is provided at top and bottom ends of a passenger conveyor and detects step surfaces of the steps on a returning side, and wherein the second proximity sensor is provided in the vicinity of the first proximity sensor at the top and bottom ends of the passenger conveyor, and detects portions of the steps on the returning side.

* * * * *